US006561087B1

(12) United States Patent
Gambini

(10) Patent No.: US 6,561,087 B1
(45) Date of Patent: May 13, 2003

(54) MULTI-PURPOSE EMBOSSING MACHINE FOR PRODUCING EMBOSSED PAPER

(76) Inventor: Giovanni Gambini, Via A. Omodeo 7, I-56100 Pisa (IT)

( * ) Notice: Subject to any disclaimer, the term of this patent is extended or adjusted under 35 U.S.C. 154(b) by 231 days.

(21) Appl. No.: 09/698,829

(22) Filed: Oct. 27, 2000

(30) Foreign Application Priority Data

Nov. 2, 1999 (IT) ..... MI99A2281

(51) Int. Cl.[7] ..... B41F 1/07
(52) U.S. Cl. ..... 101/3.1; 101/23
(58) Field of Search ..... 400/3; 101/3.1, 101/22–25, 32, 212, 216; 156/209; 72/77

(56) References Cited

U.S. PATENT DOCUMENTS

| | | | | | |
|---|---|---|---|---|---|
| 3,088,399 | A | * | 5/1963 | Broderick | 101/23 |
| 3,307,673 | A | * | 3/1967 | Jackson | 101/22 |
| 3,815,494 | A | * | 6/1974 | Bahnmüller | 101/23 |
| 4,116,028 | A | | 9/1978 | Okamoto et al. | |
| 4,198,994 | A | | 4/1980 | Germain | |
| 4,556,527 | A | | 12/1985 | Sarcander | |
| 4,785,648 | A | * | 11/1988 | Buorean et al. | 72/77 |
| 5,921,175 | A | * | 7/1999 | Bates | 101/23 |
| 6,053,232 | A | * | 4/2000 | Biagiotti | 156/209 |
| 6,109,326 | A | * | 8/2000 | Leakey et al. | 156/209 |

FOREIGN PATENT DOCUMENTS

| | | | |
|---|---|---|---|
| DE | 2810754 | * 3/1978 | |
| GB | 2118467 | * 11/1983 | 101/23 |
| GB | 2 210 767 | 6/1989 | |
| WO | WO 98/05449 | 2/1998 | |

* cited by examiner

*Primary Examiner*—Eugene H. Eickholt
(74) *Attorney, Agent, or Firm*—Hedman & Costigan, P.C.

(57) ABSTRACT

A multi-purpose embossing machine (11) for producing embossed paper comprises a bottom body (12), which supports a first embossing assembly (3,4) that works associated to a second embossing assembly (36). The machine 11 has a top body (18) which supports the second embossing assembly (36) in a position corresponding to the first embossing assembly (34), said top body (18) being connected to the bottom body (12) via a supporting and actuating element (52, 54) designed to support at least part of the weight of the top body (18) during operation of the embossing machine (11) and to enable the bottom body (12) and the top body (18) to be moved apart from one another in a situation of danger. Also provided is a resting element (26) set between the top body (18) and the bottom body (12).

10 Claims, 2 Drawing Sheets

MULTI-PURPOSE EMBOSSING MACHINE FOR PRODUCING EMBOSSED PAPER

Figure 1:
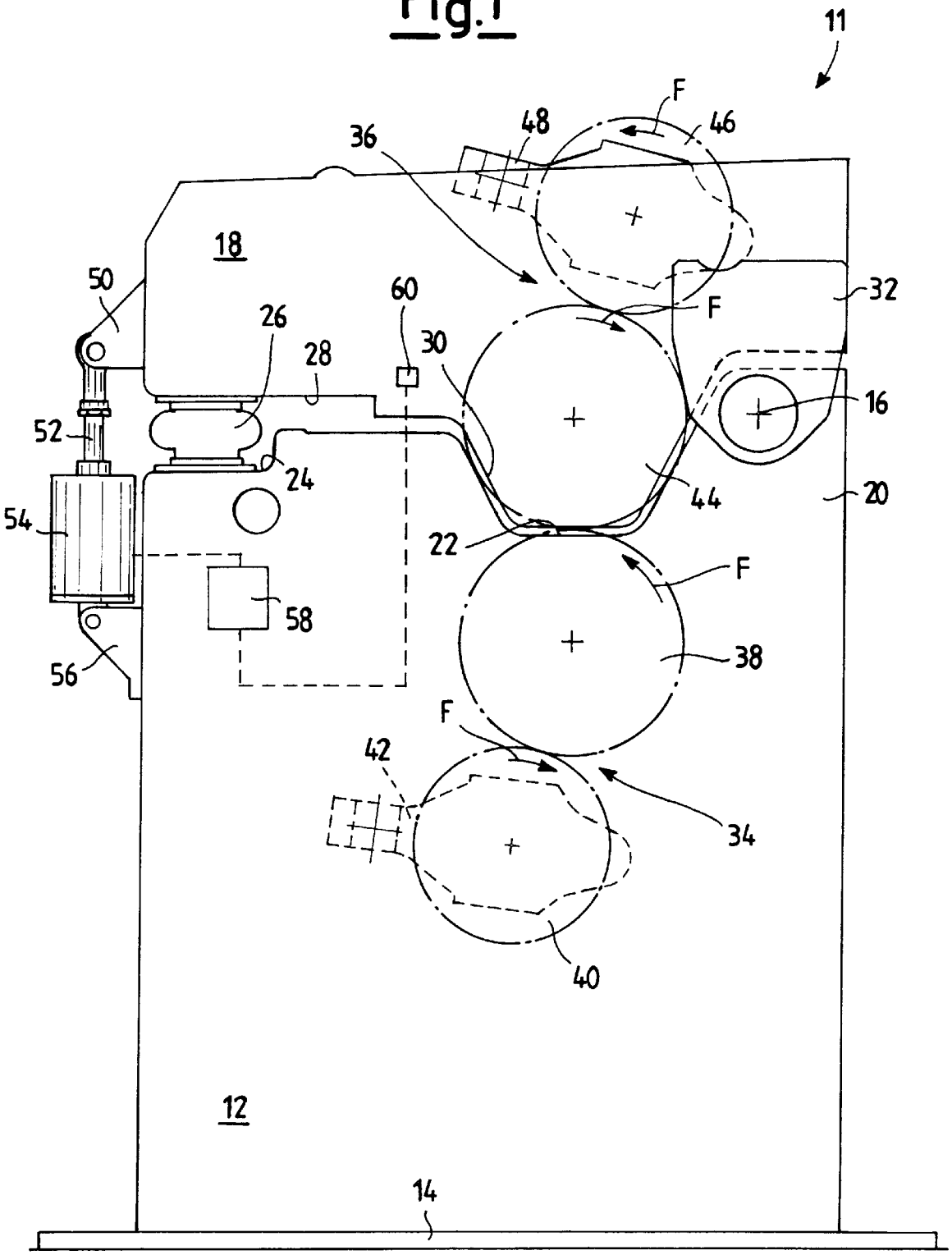

The present invention refers to a multi-purpose embossing machine for producing embossed paper.

It is known that embossing machines are designed to modify the appearance of plane and smooth sheets of paper, bestowing on them a rough, crinkled appearance or an appearance presenting patterns or motifs in relief.

At present, embossing machines are made with a structure that supports a pair of embossing assemblies set facing one another, with one on top and one underneath.

Each of said embossing assemblies comprises a steel embossing cylinder provided with protruding elements which reproduce the motifs that are to be impressed. The said cylinder is paired with another cylinder that is coated with compliant material, such as rubber, paper or leather.

The four cylinders are set aligned, with the embossing cylinders of the top embossing assembly and the bottom embossing assembly adjacent to one another.

When the machine is started, each of the two embossing assemblies is fed with a sheet which, as it passes between the embossing roller and coated roller, assumes the impression of the rollers; i.e., it is embossed. The said sheets are frequently made of paper; however, they may be made of any suitable material and different from paper.

An adhesive is laid on the two embossed sheets, and then, in the area corresponding to the area where the two embossing rollers come into contact, the sheets are set on top of one another and glued together in such a way as to obtain a paper product, such as a serviette.

Traditional embossing machines that operate according to the scheme indicated above may, in certain situations, prove far from reliable.

In fact, at times, during processing, one or both of the sheets of paper may get torn, creased, or rolled up in a ball, and may generate what in jargon is called a "wig". The "wig" is nothing other than a mass of material of dimensions such as to obstruct or altogether prevent the passage of material between the two embossing rollers.

When this occurs, following upon the passage of the "wig", one or both of the embossed rollers undergo bending and/or abrasions which damage them and render necessary subsequent operations of maintenance or replacement of the damaged elements.

In addition, in such a situation there may arise problems regarding the safety of the machine operators, linked to the possibility that pieces of material of the sheets or broken elements of the machine may be hurled out.

A purpose of the present invention is therefore to eliminate the technical drawbacks referred to above by making a multi-purpose embossing machine for producing embossed paper, which is very reliable, in particular limiting or excluding altogether all the damage due to the formation of "wigs".

Another purpose of the invention is to provide an embossing machine which is very safe.

Not the least important purpose of the present invention is that of providing a multi-purpose embossing machine which is basically simple and inexpensive.

These and other purposes according to the present invention are achieved by providing a multi-purpose embossing machine for producing embossed paper, according to claim 1.

Other characteristics of the present invention are moreover defined in the ensuing claims.

Advantageously, the embossing machine according to the present invention makes it possible to facilitate and speed up considerably the operations for its maintenance. In fact, as will appear more clearly evident from what follows, the embossing machine may be opened in order to separate the two embossing assemblies in an extremely simple way and without it being necessary to dismantle the machine completely. This obviously affects costs for running and maintenance, which are reduced considerably.

Another important feature of the present invention is that it may be applied both to tip-to-tip embossing machines and to embossing machines that use the "NESTED" embossing system.

Figure 2:
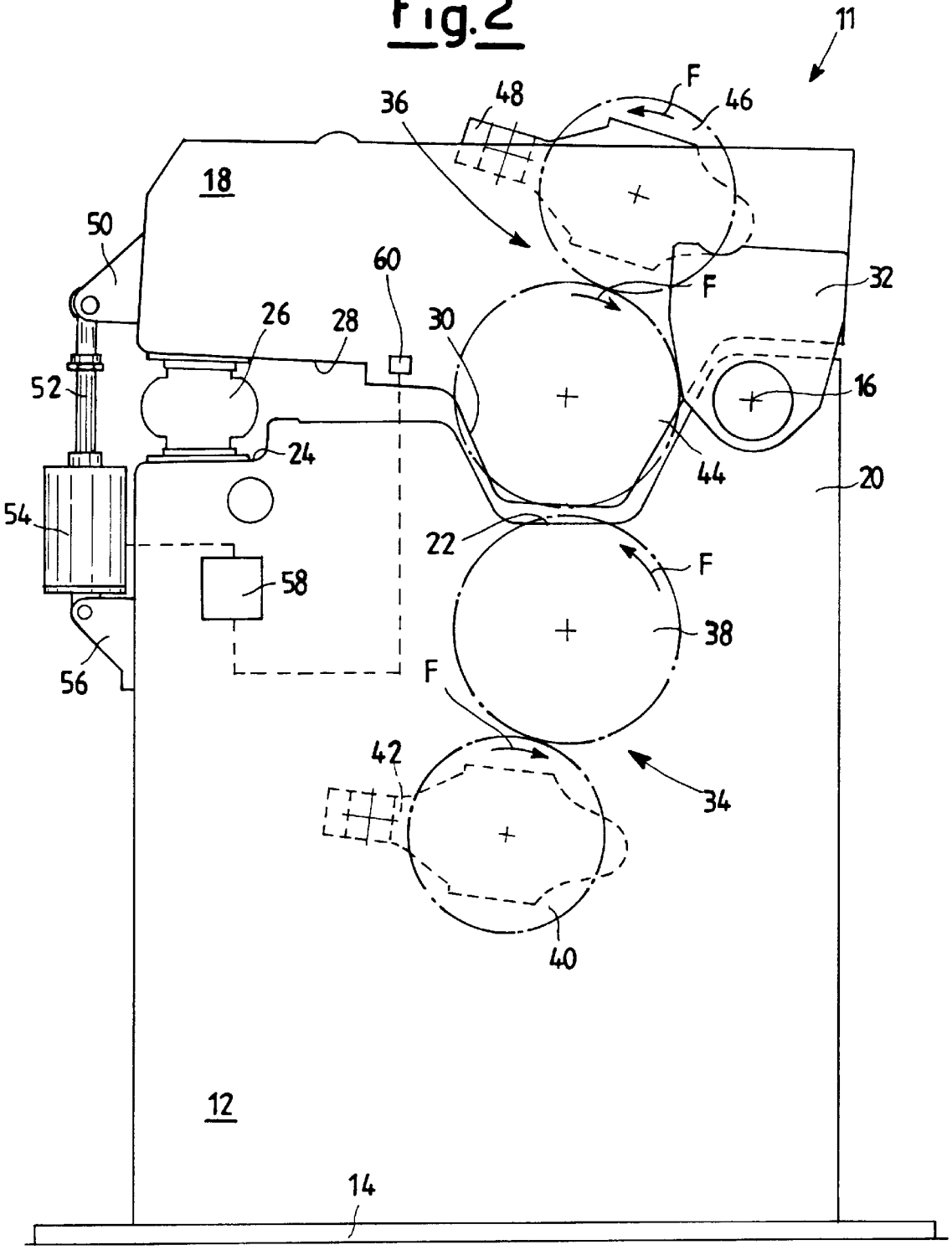

Further characteristics and advantages of a multi-purpose embossing machine according to the present invention will emerge more clearly evident from the ensuing description, which is provided purely to furnish an explanatory and non-limiting example, with reference to the annexed drawings, and in which:

FIG. 1 is a schematic view of a multi-purpose embossing machine according to the invention, in the closed working position; and FIG. 2 is a schematic view of the embossing machine of FIG. 1, in the open position.

With reference to the figures mentioned above, a multi-purpose embossing machine for producing embossed paper is illustrated, and the machine as a whole is designated by the reference number 11.

The machine 11 comprises a box-like bottom body 12 fixed to a machine bed 14 to which is articulated or hinged, in 16, a top body 18, which is also box-like.

The bottom body 12 has at one of its ends a projection or shoulder 20 in a position corresponding to which there is set the hinging, in 16. Adjacent to the shoulder 20, the body 12 has concavities 22 and, at one end opposite to the one where the hinging is set, the body 12 has a plane seat 24 in which a first end of a torpless 26 (rubber cylinder) is fixed as a resting element.

The torpless 26 consists of a rubber chamber at the ends of which are set supports which enable it to be fixed.

A second end of the torpless 26 is fixed to a seat 28 set at one end of the top body 18. Adjacent to the said seat 28, the top body 18 has projections 30 that can be inserted into the concavities 22. At one end opposite to the one where the torpless 26 is fixed, flanges 32 are fixed. To the flanges 32 is hinged, in 16, the bottom body 12.

Each one of the bodies 12, 18 supports an embossing assembly 34, 36.

One first embossing assembly 34 is supported by the bottom body 12 and comprises an embossing cylinder 38 combined with a cylinder coated with compliant material 40, such as rubber, leather, or paper.

The embossing cylinder 38, which is usually made of steel, is directly supported by the body 12 and has on its surface projections and grooves designed to impress the surface of sheets of paper that pass through the embossing assembly 34.

The coated cylinder 40, instead, is supported by levers 42, which in turn are supported by the body 12. The levers 34 can be rotated and blocked to enable insertion of the sheets of paper at the start of processing.

The embossing cylinder 38 projects slightly from the concavity 22 in such a way as to combine with an embossing cylinder 44 forming part of the second embossing assembly 36.

The embossing assembly 36 is similar to the assembly 34 and comprises, in addition to the embossing cylinder 44, also a coated cylinder 46 supported by levers 48 which can be rotated and blocked.

The machine 11 according to the present invention may adopt a system of the "NESTED" type, i.e., one in which the projections of the embossing cylinder 38 fit into the grooves of the embossing cylinder 44, and vice versa, i.e., where the projections of the cylinder 44 fit into the grooves of the cylinder 38.

The cylinders 40, 38, 44, 46 are set on top of one another. In particular, the cylinders 38 and 44 are aligned with one another; instead, the cylinder 40 is displaced towards the torpless 26 with respect to the cylinder 38, and the cylinder 46 is displaced towards the hinging, set in 16, with respect to the cylinder 44.

In a position corresponding to one side of the top body 18 adjacent to the torpless 26, is fixed a flange 50, where a rod 52 of a pneumatic cylinder 54 is hinged as a supporting and actuating element. The cylinder 54 in turn is hinged to a flange 56 fixed to one side of the bottom body 12 adjacent to the torpless 26.

The machine 11 is moreover provided with a control device 58 which is able to detect the formation of a "wig" and to move the bodies 12, 18 away from one another. The device 58 is connected both to a sensor 60 for emitting a signal of fast release and to the cylinder 54.

Also present are photocells (not represented for reasons of simplicity) at input and at output with respect to the machine to signal whether any tearing of the paper has occurred or some other form of malfunctioning.

Operation of an embossing machine 11 for producing embossed paper according to the invention is substantially as described below.

During normal operation of the machine 11 (FIG. 1), the top body 18 is lowered onto the bottom body 12 in such a way as to combine the two embossing cylinders 38, 44. The cylinders 38, 40, 44, 46 rotate as indicated by the arrows F. The weight of the top body 18 is mostly (up to 80–90%) supported, apart from by the hinging set in 16, by the torpless 26, and only the very small remaining part is supported by the cylinder 54.

In this situation, each of the two embossing assemblies 34, 36 impresses a sheet (not shown for reasons of simplicity) in points corresponding to the areas where the cylinders 38, 40 for the assembly 34, and 44, 46 for the assembly 36, combine. The sheets thus impressed are set together and glued together in points corresponding to the area where the embossing cylinders 38 and 44 combine.

When a "wig" is formed, instead, the sensor 60 transmits a signal to the device 58, which in turn sends a command for fast release of the top body 18 from the bottom body 12 (FIG. 2).

When this happens, the device 58 sends a command for extension of the rod 52 from the cylinder 54 and the consequent prompt removal of the body 18 from the body 12. The presence of the torpless 26 enables the body 18 and the body 12 to be moved away from one another in an extremely fast way, there being necessary powers that are smaller than those that would be necessary if the torpless were absent.

In practice, it has been found that the structure for supporting embossing rollers in an embossing machine according to the invention is particularly advantageous because it enables machines that are very reliable and safe to be made.

The structure for supporting embossing rollers in an embossing machine thus devised may undergo numerous modifications and variations, all of which fall within the scope of the invention. Furthermore, all the items may be replaced by elements that are technically equivalent.

In practice, the materials used, as well as the dimensions, may be any whatsoever according to the technical requirements.

What is claimed is:

1. A multi-purpose embossing machine (11) for producing embossed paper, comprising at least one bottom body (12), which supports at least one first embossing assembly (34) that works associated to at least one second embossing assembly (36), characterized in that it has at least one second top body (18) which supports at least said second embossing assembly (36), where between said bottom body (12) and said top body (18) is set at least one resting element (26), and where said top body (18) is connected to said bottom body (12) via at least one supporting and actuating element (52, 54) designed to support at least part of the weight of said top body (18) during operation of said embossing machine (11) and to enable said bottom body (12) and said top body (18) to be moved away from one another in a situation of danger wherein said top body (18) is articulated (16) to said bottom body (12).

2. An embossing machine (11) according to claim 1, characterized in that said resting element (26) comprises at least one torpless.

3. An embossing machine (11) according to claim 1, characterized in that said supporting and actuating element (52, 54) comprises at least one cylinder (54) associated to a rod (52).

4. An embossing machine (11) according to claim 1, characterized in that said top body (18) has one end hinged (16) to said bottom body (12), said supporting an actuating element (52, 54) and a resting element (26) being connected to an opposite end of said bottom body (12) an to an opposite end of said top body (18).

5. An embossing machine (11) according to claim 1, characterized in that it adopts a "NESTED"-type embossing system, i.e., one in which the projections of one first embossing cylinder (38) of said first embossing assembly (34) fit into the grooves of one second embossing cylinder (44) of said second embossing assembly (36), and vice versa.

6. An embossing machine (11) according to claim 1, characterized in that it adopts a tip-to-tip embossing system.

7. An embossing machine (11) according to claim 1, characterized in that one coated cylinder (46) and one embossing cylinder (44) of said second embossing assembly (36), and one embossing cylinder (38) and one coated cylinder (40) of said first embossing assembly (34) are set in order on top of each other.

8. An embossing machine (11) according to claim 7, characterized in that said embossing cylinders (38, 44) are set aligned to each other, whilst said coated cylinders (40, 46) are out of line with respect to said embossing cylinders (38, 44).

9. An embossing machine (11) according to claim 8, characterized in that said coated cylinder (40) of said first embossing assembly (34) is displaced towards a resting element (26) with respect to said embossing cylinder (38) of said first embossing assembly (34), and said embossing cylinder (46) of said second embossing assembly (36) is displaced towards a hinging (16) with respect to said embossing cylinder (44) of said second embossing assembly (36).

10. An embossing machine (11) according to claim 1, characterized in that it comprises at least one control device (58) connected to at least one sensor (60) which is designed to detect the presence of a "wig" and is connected to said supporting and actuating element (52, 54) so as to be able to actuate the latter.

* * * * *